US010196712B2

(12) United States Patent
Ederyd

(10) Patent No.: US 10,196,712 B2
(45) **Date of Patent: *Feb. 5, 2019**

(54) LOW CARBON STEEL AND CEMENTED CARBIDE WEAR PART

(71) Applicant: SANDVIK INTELLECTUAL PROPERTY AB, Sandviken (SE)

(72) Inventor: Stefan Ederyd, Saltsjo-Boo (SE)

(73) Assignee: Sandvik Hyperion AB, Stockholm (SE)

( * ) Notice: Subject to any disclaimer, the term of this patent is extended or adjusted under 35 U.S.C. 154(b) by 413 days.

This patent is subject to a terminal disclaimer.

(21) Appl. No.: 14/440,910

(22) PCT Filed: Nov. 7, 2013

(86) PCT No.: PCT/IB2013/059977

§ 371 (c)(1),
(2) Date: May 6, 2015

(87) PCT Pub. No.: WO2014/072932

PCT Pub. Date: May 15, 2014

(65) Prior Publication Data

US 2015/0299827 A1 Oct. 22, 2015

Related U.S. Application Data

(60) Provisional application No. 61/724,122, filed on Nov. 8, 2012.

(51) Int. Cl.
*C22C 1/10* (2006.01)
*B22D 19/00* (2006.01)
(Continued)

(52) U.S. Cl.
CPC ..... *C22C 1/101* (2013.01); *B22D 19/0081* (2013.01); *B22D 19/02* (2013.01);
(Continued)

(58) Field of Classification Search
CPC ..... C22C 1/101; C22C 47/08; C22C 49/08; C22C 49/14; C22C 47/04; C22C 29/02;
(Continued)

(56) References Cited

U.S. PATENT DOCUMENTS 4,146,080 A * 3/1979 Baum ..... B22D 19/02 164/100
4,499,795 A 2/1985 Radtke
(Continued)

FOREIGN PATENT DOCUMENTS

JP H4506180 A 10/1992
JP 2011505251 A 2/2011

*Primary Examiner* — Anthony J Zimmer

(57) ABSTRACT

The present disclosure relates to a wear part having high wear resistance and strength and a method of making the same. The wear part is composed of a compound body of cemented carbide particles cast with a low-carbon steel alloy. The low-carbon steel alloy has a carbon content corresponding to a carbon equivalent Ceq=wt % C+0.3(wt % Si+wt % P) of about 0.1 to about 1.5 weight %. The wear part could include a body with a plurality of inserts of cemented carbide particles cast into a low-carbon steel alloy disposed in the body. Each of the plurality of cemented carbide inserts are coated with at least one layer of oxidation protection/chemical resistant material. The plurality of inserts are directly fixed onto a mold corresponding to the shape of the wear part. The cemented carbide inserts are then encapsulated with the molten low-carbon steel alloy to cast the cemented carbide inserts with the low-carbon steel alloy.

25 Claims, 3 Drawing Sheets

(51) Int. Cl.

| | |
|---|---|
| ***C22C 47/08*** | (2006.01) |
| ***C22C 49/08*** | (2006.01) |
| ***C22C 49/14*** | (2006.01) |
| ***C22C 49/04*** | (2006.01) |
| ***C22C 29/02*** | (2006.01) |
| ***B22D 19/02*** | (2006.01) |
| ***B22D 19/14*** | (2006.01) |
| ***B22D 19/06*** | (2006.01) |
| ***C22C 29/08*** | (2006.01) |
| ***C22C 47/04*** | (2006.01) |

(52) U.S. Cl.
CPC ..... *B22D 19/06* (2013.01); *B22D 19/14* (2013.01); *C22C 1/1036* (2013.01); *C22C 29/02* (2013.01); *C22C 47/04* (2013.01); *C22C 47/08* (2013.01); *C22C 49/08* (2013.01); *C22C 49/14* (2013.01); *C22C 29/08* (2013.01)

(58) Field of Classification Search
CPC ... C22C 1/1036; C22C 29/08; B22D 19/0081; B22D 19/02; B22D 19/14; B22D 19/06; B22C 19/06
See application file for complete search history.

(56) References Cited

U.S. PATENT DOCUMENTS

| | | | | |
|---|---|---|---|---|
| 5,008,132 | A * | 4/1991 | Kuo | C04B 41/009 427/215 |
| 5,066,546 | A | 11/1991 | Materkowski | |
| 5,587,233 | A | 12/1996 | Konig et al. | |
| 6,139,921 | A | 10/2000 | Taeschner | |
| 6,372,346 | B1 * | 4/2002 | Toth | B22F 1/025 428/325 |
| 6,641,918 | B1 * | 11/2003 | Sherman | B22F 1/025 427/213 |
| 2009/0148336 | A1 * | 6/2009 | Ederyd | B22D 19/02 420/94 |
| 2010/0038147 | A1 * | 2/2010 | Lockstedt | B22F 1/0096 175/426 |

* cited by examiner

LOW CARBON STEEL AND CEMENTED CARBIDE WEAR PART

RELATED APPLICATION DATA

This application is a § 371 National Stage Application of PCT International Application No. PCT/IB2013/059977 filed Nov. 7, 2013 claiming priority of U.S. Provisional Patent Application No. 61/724,122, filed Nov. 8, 2012.

TECHNICAL FIELD AND INDUSTRIAL APPLICABILITY

The present disclosure relates to a wear part of cemented carbide (CC) particles cast into low carbon steel having a unique product design and performance and a wear part having inserts made of the cast CC particles and low carbon steel. The compound material concept is especially suitable for drill bits used in mining and oil and gas drilling, rock milling tools, tunnel boring machine cutters/discs, impellers, and wear parts used in machine parts, instruments, tools etc., and particularly in components exposed to great wear.

SUMMARY

A wear part of an embodiment having high wear resistance and strength composed of a compound body of cemented carbide particles cast with a low-carbon steel alloy, wherein the low-carbon steel alloy has a carbon content corresponding to a carbon equivalent Ceq=wt % C+0.3(wt % Si+wt % P) of about 0.1 to about 1.5 weight percent.

A method of forming a high wear resistant, high strength wear part of another embodiment includes the steps of providing a quantity of cemented carbide particles and positioning the cemented carbide particles into a mold. Molten low-carbon steel alloy, having a carbon content corresponding to a carbon equivalent Ceq=wt % C+0.3(wt % Si+wt % P) of about 0.1 to about 1.5 wt % is delivered into the mold. The cemented carbide particles are encapsulated with the molten low-carbon steel alloy to cast a matrix of cemented carbide particles and low-carbon steel alloy.

A wear part of yet another embodiment, having high wear resistance and strength is provided. The wear part includes a body with a plurality of inserts of cemented carbide particles cast into a low-carbon steel alloy disposed in the body. The low-carbon steel alloy has a carbon content corresponding to a carbon equivalent Ceq=wt % C+0.3(wt % Si+wt % P) of about 0.1 to about 1.5 weight percent.

A method of forming a high wear resistant, high strength wear part of still another embodiment includes the steps of forming a plurality of cemented carbide inserts, the inserts being formed by encapsulating cemented carbide particles with a molten low-carbon steel alloy to cast a matrix of cemented carbide particles and low-carbon steel alloy, the low-carbon steel alloy having a carbon content of about 1 to about 1.5 weight percent. Each of the plurality of cemented carbide inserts are coated with at least one layer of oxidation protection/chemical resistant material. The plurality of inserts are directly fixed onto a mold corresponding to the shape of the wear part. The cemented carbide inserts are encapsulated with the molten low-carbon steel alloy to cast the cemented carbide inserts with the low-carbon steel alloy.

These and other objects, features, aspects, and advantages of the present invention will become more apparent from the following detailed description of embodiments relative to the accompanied drawings, in which:

DETAILED DESCRIPTION

One aspect of the present invention relates to the casting of cemented carbide particles/bodies into low carbon steel to manufacture unique products and designs having improved wear resistance performance. This compound material is especially suitable for drill bits used in mining and oil and gas drilling, rock milling tools, TBM-cutters/discs, impellers, sliding wear parts, and wear parts used in machine parts, instruments, tools, etc., and particularly in components exposed to great wear. It should be appreciated that other products or parts are contemplated by the present invention. Further aspects of the invention provide, in respective aspects, a tool, drill bit, rock milling tool, TBM-cutter/disc, impeller, and sliding part, each comprising a wear part as described herein, suitably two or more wear parts.

Figure 1:
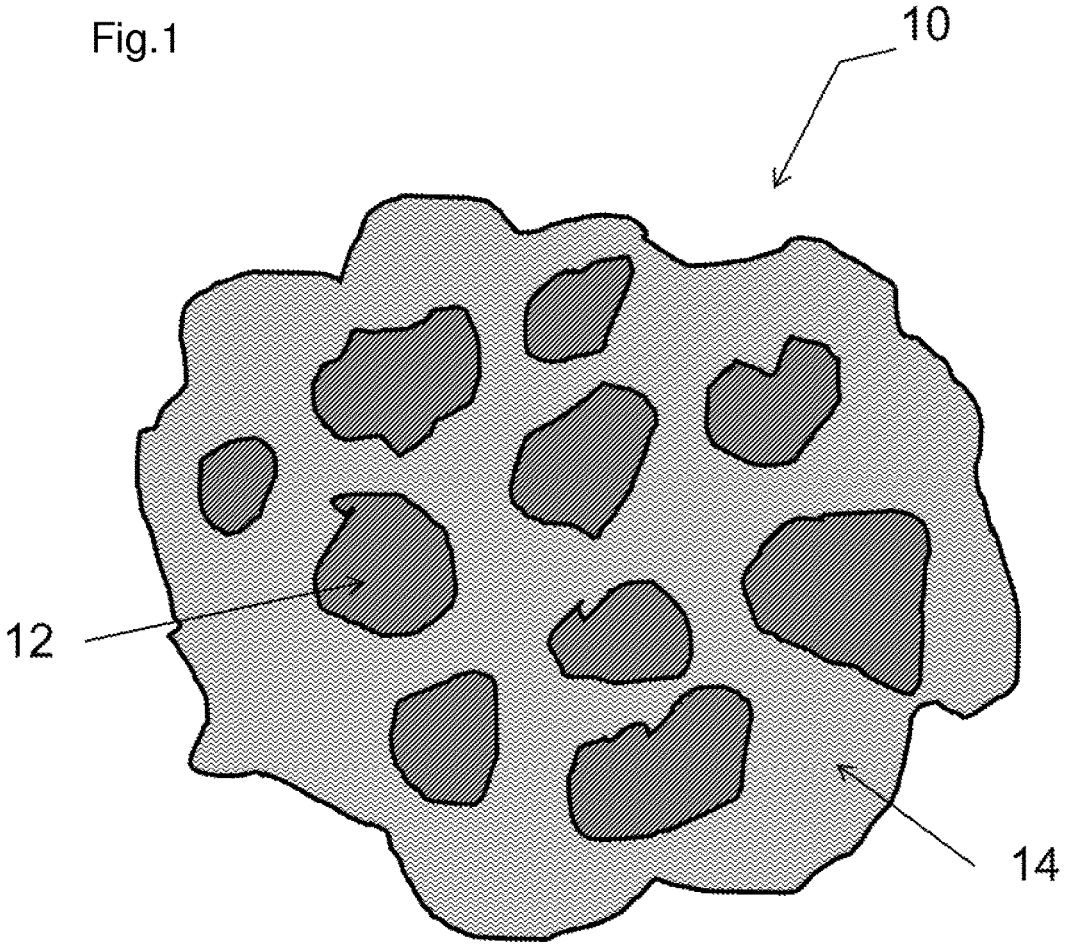
FIG. 1 is an exemplary microstructure of the cemented carbide particle, low-carbon steel alloy matrix of the present invention.

Referring to FIG. 1, a body 10 of the wear part includes cemented carbide particles 12 and a binder of low-carbon steel alloy 14. The cemented carbide particles can be cast with low-carbon steel alloy 14. Low-carbon steel alloy has a carbon content corresponding to a carbon equivalent Ceq=wt % C+0.3(wt % Si+wt % P) of about 0.1 to about 1.5 weight percent.

As is known, cemented carbide particles are used as wear resistance material and can be formed using a variety of techniques. For example, the cemented carbide is present as pieces, crushed material, powder, pressed bodies, particles or some other shape. The cemented carbide, which contains at least one carbide besides a binder metal, is normally of WC—Co-type with possible additions of carbides of Ti, Ta, Nb or other metals, but also hard metal containing other carbides and/or nitrides and binder metals may be suitable. In exceptional cases also pure carbides or other hard principles, i.e. without any binder phase, can be used. The cemented carbide could also be replaced by cermet depending on the wear application. A cermet is a lighter metal matrix material normally used in wear parts with high demands on oxidation and corrosion resistance. The low-carbon steel alloy could be replaced by another heat resistant alloy e.g. Ni-based alloy, Inconel etc.

The particle size and the content of crushed carbide particles will influence the wettability of the steel due to the difference in the thermal conductivity between the two materials. A satisfactory wetting or metallurgical bond between the hard material and the steel could be maintained in preheated molds with enough high proportion of molten steel.

In order to provide the best wear and resistance properties, it is preferable that the CC particles have a granular size so that a good balance with regards to the heat capacity and the heat conductivity between the steel and the CC particles could be obtained for the best possible wetting of the steel onto the CC particles. The size volume of the CC particles should be about 0.3 to about 20 $cm^3$.

To maintain the best wear resistance of the hard compound material, the CC particles should be exposed at the surface of the wear part. Therefore, the shape of the particles is important to maintain a large wear flat surface area and a good bonding to the steel matrix. The thickness of the particles should be about 5 to about 15 mm.

As shown in FIG. 1, the cast cemented carbide particles ("CC particles") 12 are surrounded and encapsulated by the low-carbon steel alloy 14 to form a matrix. The CC particles cast into low carbon steel have a good fitting to the steel without voids. The carbon content of the steel is about 0.1 to about 1.5 weight % of carbon. Carbon contents in this range will raise the melting point of the steel/alloy above the melting point of the binder-phase in the CC particles. To prevent the dissolution of the CC particles, the CC particles are coated with alumina.

Figure 2:
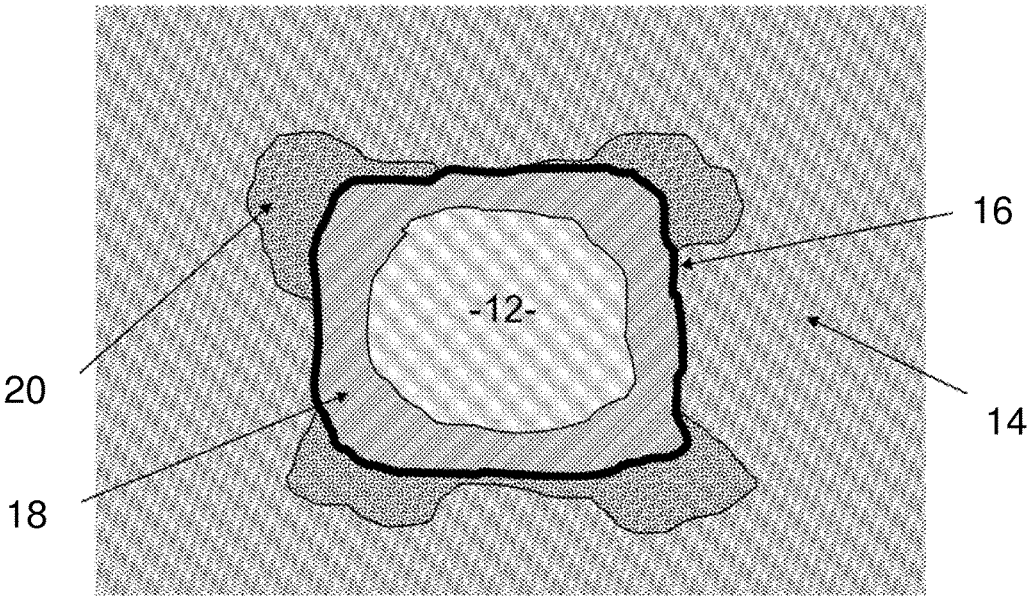
FIG. 2 is an enlarged microstructure of the present invention.

As will be described further herein, the molten low-carbon steel 14 is cast with CC particles 12 to form the matrix. Referring to FIG. 2, CC particles 12 are coated with a thin coating 16 of alumina. The protective coating of alumina is applied preferably with a CVD coating technique and the coating thickness should be very thin if it is applied onto another hard coating, e.g. TiN, (Ti,Al)N, TiC). It is preferable that the CC particles have an alumina coating thickness of about 1 to about 8 μm. The coating could have multiple layers and especially with CC particles having a binder phase content of Ni it is important to have a pre-layer of, e.g. TiN, to make the alumina coating possible. It should be appreciated that other coating techniques can be used, for example, microwave, plasma, PVD, etc.

During the casting process, the alumina coating 16 will prevent the steel from reacting with the CC and the dissolution of the CC is restricted to the parts of the CC particles where the alumina coating has a hole that provides a "leakage." The controlled leakage of the steel makes a surface zone 18 about the CC particles with an alloying of the binder-phase with content of Iron (Fe) and other alloying elements from the steel, e.g. Cr. An intermediate reaction zone 20, shown at the corners of the particle, is restricted to the parts in the steel where the holes in the alumina coating are found. The difference in the volume expansion coefficient between the steel and the CC particles provides favorable compressive stresses around the CC particle. The alloying of the binder-phase in the outer zone of the CC particle gives also compressive stresses to the "core" of the CC particle.

Due to the alumina coating, the dissolution of the CC is controlled and the surface zone 18 is formed between the steel and the CC where the alumina coating has holes. The surface zone keeps the content of brittle hard phases (eta-phase/$M_6C$ carbides, M=W, Co, Fe and dendrites of W-alloys) and is not beneficial for the wear resistance of the wear part. Just a small portion of the CC is dissolved at surface zone 18, about 0.1 to about 0.3 mm thick zone of the CC particles where a hole in the alumina coating has occurred. No observed transition "zone" could be found between the alumina coating and steel.

The wear part of the present invention can be formed by known casting techniques. The CC particles can be positioned within a mold that corresponds to the desired shape of the part. The CC particles are preferably positioned in the mold so as to be at the surface of the resulting wear part. In this position the CC particles are exposed to air. The molten low-carbon steel alloy is then delivered to the mold to form the matrix of particles and alloy. The casting of the matrix is heated to about 1550 to about 1600° C. After the casting it can be subjected to hardening, annealing and tempering as is known in the art.

Figure 3:
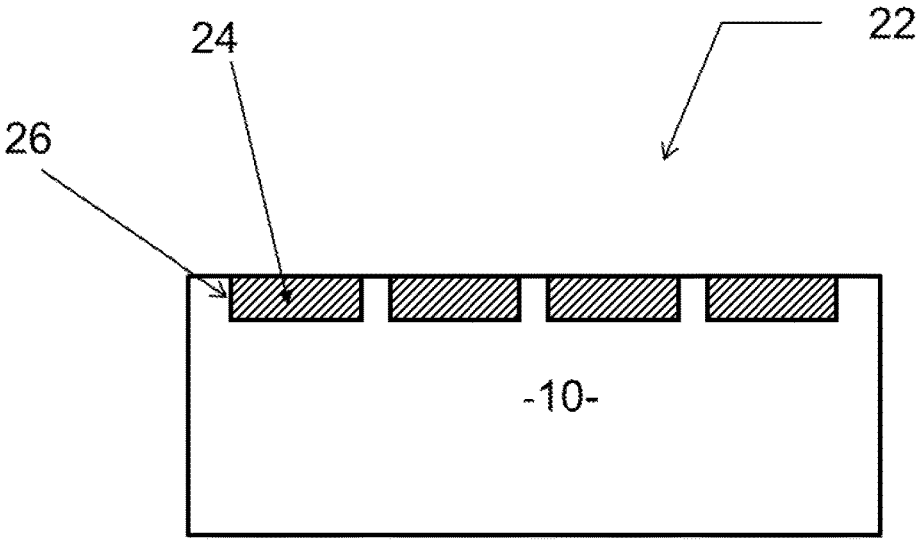
FIG. 3 is a cross-section of a coated wear part of the present invention.

Referring to FIG. 3, a wear part 22 having a body 10 can include a plurality of CC inserts 24 located therein. Inserts 24 are formed of cemented carbide particles cast with low-carbon steel alloy as described above. The low-carbon steel alloy has a carbon content corresponding to a carbon equivalent Ceq=wt % C+0.3(wt % Si+wt % P) of about 0.1 to about 1.5 weight percent.

Inserts 24 include a coating 26 to prevent oxidation. Coating 26 is made of alumina, for example $Al_2O_3$, and reacts with the steel without harming the bonding between the steel and the CC particles, as described above.

The CC inserts should be exposed at the surface of the wear part. Therefore, the shape of the particles is important to maintain a large wear flat surface area and a good bonding to the steel matrix. The thickness of the inserts should be about 5 to about 15 mm.

As described above, during the casting process the alumina coating 26 will prevent the steel from reacting with the CC and the dissolution of the CC is restricted to the parts of the CC inserts where the alumina coating has a hole that provides "leakage." The protective coating of alumina is applied preferably with the CVD coating technique and the coating thickness should be very thin if it is applied onto another hard coating, e.g. TiN, (Ti,Al)N, TiC). It is preferable that the CC inserts have an alumina coating thickness of about 1 to about 8 μm. The coating could have multiple layers and especially with CC inserts having a binder phase content of Ni it is important to have a pre-layer of, e.g. TiN, to make the alumina coating possible. The coating can be applied via a CVD coating technique or other coating techniques such as plasma, microwave, PVD etc.

The wear part of an embodiment can be formed by known casting techniques. The coated CC inserts can be positioned within a mold that corresponds to the desired shape of the part. The CC bodies may be positioned in the mold so as to be at the surface of the resulting wear part. In this position the CC inserts are exposed to air. The molten low-carbon steel alloy is then delivered to the mold to form the matrix of particles and alloy. The casting of the matrix is heated to about 1550 to about 1600° C. After the casting it can be subjected to hardening, annealing and tempering as is known in the art.

Due to the surface oxidation protection of the alumina coating, the CC-inserts may be directly fixed to the surface of the mold, i.e., with screws, net, nail, etc., without the need for the steel melt to completely cover the particles/inserts. This technique makes it possible to directly form, for example, a drill bit with CC inserts or buttons fitted to the steel body. The casting process with hardening, annealing and tempering has shown that the CC survives in the wear part due to the alumina coating of the CC inserts.

Example 1

Tamping tools according to the invention were manufactured by casting the complete tool by slip casting. The finished tamping tool had a steel shaft and a wear paddle covered by square type cemented carbide inserts with a side length of 28 mm and a thickness of 7 mm. The inserts of cemented carbide were prepared by a conventional powder metallurgical technique, having a composition of 8 wt % Co and the remaining being WC with a grain size of 1 μm. The carbon content was 5.55 wt %. The sintered cemented carbide inserts were alumina-coated in a CVD-reactor at 920° C. After the CVD-process the inserts were completely covered by a black alumina coating with a thickness of 4 μm.

The inserts were fixed with nails in the mold for the manufacturing of the tamping tool. A steel of type CNM85 with a composition of 0.26% C, 1.5% Si, 1.2% Mn, 1.4% Cr, 0.5% Ni, and 0.2% Mo was melted and the melt was poured into the molds at a temperature of 1565° C. After air cooling, the teeth were normalized at 950° C. and hardened at 1000° C. Annealing at 250° C. was the final heat treatment step before blasting and grinding the tool to its final shape. The hardness of the steel in the finished tools was between 45 and 55 HRC.

Example 2

In a second experiment, aimed especially for rock milling, an insert type rock milling cutters was cast into one semi-finished part. Each milling cutter had four cutting inserts of cemented carbide with a binder phase content of 12 wt % Co. The remaining was WC with a grain size of 4 μm. The manufacturing method was the same as Example 1 above and with a steel body of type CNM85. Prior to the casting procedure the cemented carbide inserts were alumina-coated in a CVD reactor according to Example 1. The inserts were directly press-fitted into the mold before the cast procedure. After the casting the shaft was ground to the finished dimension of the rock milling cutter.

Example 3

In a third experiment aimed especially for rock milling tools, such as point attack tools, an alumina-coated cemented carbide button having a binder phase content of 6 wt % Co and the rest being WC with a grain size between 8 μm was cast. The manufacturing route was the same as Example 1 with a casting procedure of steel type CNM85 to form the semi-finished part. The fitting portion was ground to the finished shape of the point attack tool.

Figure 4:
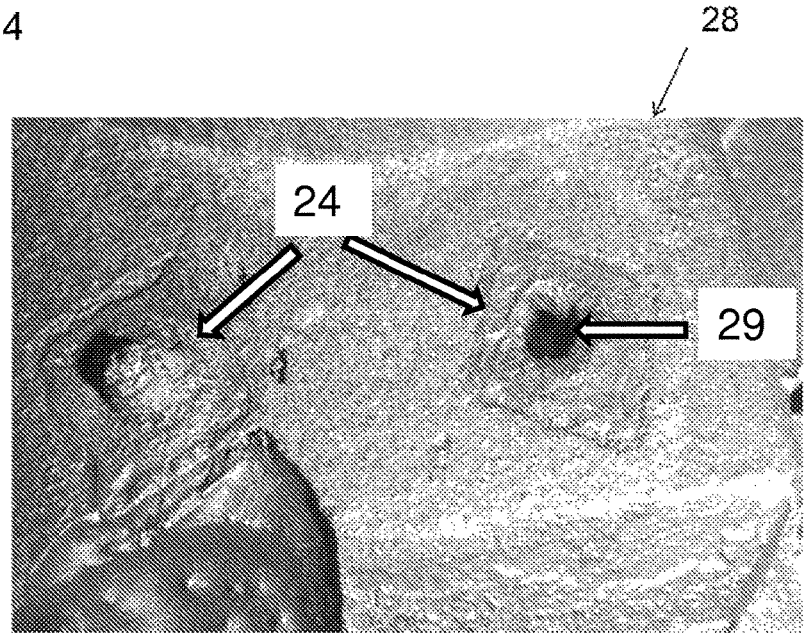
FIG. 4 is a wear part made according to the method of the present invention after casting, hardening, annealing and blasting.

The wear parts made according to the present disclosure were cast tested. FIG. 4 shows a cast 28 of high strength steel having CC inserts 24' and made according to the present invention after casting at 1565° C., hardening, annealing, tempering and blasting. The inserts were fitted directly to the mold with screws.

The carbide specimens show a good wetting without oxidation. FIG. 4 further shows that the CC inserts 24' have not just survived the casting process, but the shape of the CC inserts are kept after the casting. The hole 29 in the right insert originates from a screw that did not survive oxidation during the cast operation. The test shows that it is possible to apply CC-insert to the surface of low carbon steel. Results show that the cemented carbide wear part with the high strength and wear resistant steel alloy according to the invention has high reliability and strength with a wear performance increase that is 10 times higher than the steel commodity product.

Figure 5A:
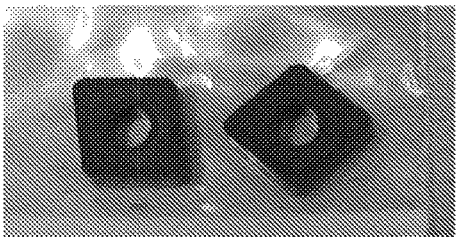
FIGS. 5A and 5B are parts tested for oxidation resistance.
Figure 5B:
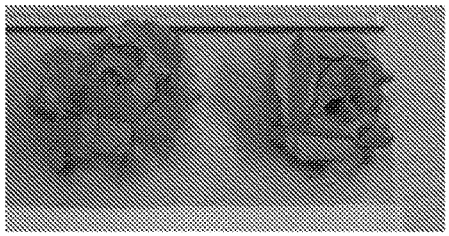

Referring to FIGS. 5A and 5B, two different parts were tested: an Alumina coated specimen (FIG. 5A) and a TiN specimen (FIG. 5B). The same type of specimens of a CC grade keeping 6% Cobalt+WC were completely coated with two types of hard coatings for an oxidation test. The coating was maintained within a CVD-reactor for both variants of inserts. Both types of inserts were completely coated prior to the oxidation test.

The oxidation results from 5 hours at 920° C. show that the alumina-coated CC specimen (FIG. 5A) does not show any oxidation. However, the TiN-coated specimen does. Thus, the casting result has shown a good wetting of the steel around the alumina-coated carbide substrate.

It should be appreciated that maintaining the compound between the low-carbon steel and the CC-particles/bodies is due to the high oxidation/chemical resistance of the CC particles/bodies. The high chemical resistance is maintained by providing an alumina coating on the CC-bodies/particles. The alumina coating is maintained preferably by a CVD-coating technique. The coating could also be applied with other techniques, e.g. PVD in a fluidized bed.

Although the present invention has been described in relation to particular embodiments thereof, many other variations and modifications and other uses will become apparent to those skilled in the art. It is preferred therefore, that the present invention be limited not by the specific disclosure herein, but only by the appended claims.

What is claimed is:

1. A wear part having high wear resistance and strength, comprising:

a body composed of cemented carbide particles cast with a low-carbon steel alloy, wherein at least one oxidation protection alumina coating is disposed on the cemented carbide particles, and wherein said low-carbon steel alloy has a carbon content corresponding to a carbon equivalent Ceq=wt % C+0.3 (wt % Si+wt % P) of about 0.1 weight percent to about 1.5 weight percent.

2. The wear part according to claim 1, wherein the cemented carbide particles of the body are encapsulated by the low-carbon steel during casting to form a matrix.

3. The wear part according to claim 2, wherein the cemented carbide particles have a granular size that is directly proportional to heat capacity and thermal conductivity such that a larger granular size of cemented carbide provides a higher heat capacity and a higher thermal conductivity, while a smaller granular size cemented carbide provides a lower heat capacity and heat conductivity.

4. The wear part according to claim 1, wherein the volume of individual cemented carbide particles in the wear part is about 0.3 $cm^3$ to about 20 $cm^3$.

5. The wear part according to claim 1, wherein said at least one oxidation protection alumina coating is from about 1 micron to about 5 micron thick.

6. The wear part according to claim 1, wherein the cemented carbide particles have an alumina coating thickness of about 5 μm to about 8 μm.

7. The wear part according to claim 1, further comprising a plurality of layers of alumina oxidation protection coating on the cemented carbide particles.

8. The wear part according to claim 1, wherein the cemented carbide particles have a binder phase content of Ni.

9. The wear part according to claim 1, further comprising a pre-layer of TiN coated on the cemented carbide particles underneath the alumina coating.

10. The wear part according to claim 1, wherein the cemented carbide particles are exposed at a surface of the wear part.

11. The wear part according to claim 1, wherein the wear part has a thickness of about 5 mm to about 15 mm.

12. A wear part having high wear resistance and strength, comprising:

a body composed of cemented carbide particles cast with a low-carbon steel alloy, wherein at least one oxidation protection $Al_2O_3$ alumina coating is disposed on the cemented carbide particles, and wherein said low-carbon steel alloy has a carbon content corresponding to a carbon equivalent Ceq=wt % C+0.3 (wt % Si+wt % P) of about 0.1 weight percent to about 1.5 weight percent.

13. The wear part according to claim 12, characterized in that the cemented carbide particles of the body are encapsulated by the low-carbon steel during casting to form a matrix.

14. The wear part according to claim 12, characterized in that the cemented carbide particles have a granular size that is directly proportional to heat capacity and thermal conductivity such that a larger granular size of cemented carbide provides a higher heat capacity and a higher thermal conductivity, while a smaller granular size cemented carbide provides a lower heat capacity and heat conductivity.

15. The wear part according to claim 12, characterized in that the volume of cemented carbide particles in the wear part ranges from about 0.3 $cm^3$ to about 20 $cm^3$.

16. The wear part according to claim 12, further comprising a plurality of layers of oxidation protection $Al_2O_3$ alumina coating disposed on the cemented carbide particles.

17. The wear part according to claim 12, characterized in that the cemented carbide particles have a binder phase content of Ni.

18. The wear part according to claim 12, further comprising a pre-layer of TiN coated on the cemented carbide particles located underneath the alumina oxidation protection coating.

19. The wear part according to claim 12, characterized in that the cemented carbide particles are exposed at a surface of the wear part.

20. A wear part having high wear resistance and strength, comprising:

a body composed of cemented carbide particles cast with a low-carbon steel alloy, wherein at least one oxidation protection alumina coating of a thickness of from 1 μm to about 8 μm is disposed on the cemented carbide particles, and wherein said low-carbon steel alloy has a carbon content corresponding to a carbon equivalent Ceq=wt % C+0.3 (wt % Si+wt % P) of about 0.1 weight percent to about 1.5 weight percent.

21. The wear part according to claim 20, characterized in that the cemented carbide particles of the body are encapsulated by the low-carbon steel during casting to form a matrix.

22. The wear part according to claim 20, characterized in that the cemented carbide particles have a granular size that is directly proportional to heat capacity and thermal conductivity such that a larger granular size of cemented carbide provides a higher heat capacity and a higher thermal conductivity, while a smaller granular size cemented carbide provides a lower heat capacity and heat conductivity.

23. The wear part according to claim 20, characterized in that the volume of cemented carbide particles in the wear part ranges from about 0.3 $cm^3$ to about 20 $cm^3$.

24. The wear part according to claim 20, further comprising a plurality of layers of oxidation protection alumina coating disposed on the cemented carbide particles.

25. The wear part according to claim 20, characterized in that the cemented carbide particles have a binder phase content of Ni.

* * * * *